US005601456A

United States Patent [19]

Takeuchi

[11] Patent Number: 5,601,456

[45] Date of Patent: Feb. 11, 1997

[54] BUS BAR CONNECTOR

[75] Inventor: Hiroshi Takeuchi, Amagasaki, Japan

[73] Assignee: Mitsubishi Denki Kabushiki Kaisha, Tokyo, Japan

[21] Appl. No.: 540,485

[22] Filed: Oct. 10, 1995

Related U.S. Application Data

[62] Division of Ser. No. 406,041, Mar. 17, 1995, Pat. No. 5,482,481, which is a division of Ser. No. 45,814, Apr. 9, 1993, Pat. No. 5,423,700.

[30] Foreign Application Priority Data

Oct. 4, 1992 [JP] Japan ..... 4-118306

[51] Int. Cl.[6] ..... H01R 13/18

[52] U.S. Cl. ..... 439/821; 439/251

[58] Field of Search ..... 439/819, 821, 439/723, 246, 249, 251; 200/258, 260, 261, 282, 287, 288, 304, 305, 144 R, 148 A, 51 R, 51.09, 51.13

[56] References Cited

U.S. PATENT DOCUMENTS 3,867,602 2/1975 Tawelak ..... 439/246

4,846,695 7/1989 Iwabuchi et al. ..... 439/17

FOREIGN PATENT DOCUMENTS 226811 7/1987 European Pat. Off. .

975843 2/1963 Germany .

61-82367 5/1986 Japan .

61-104939 7/1986 Japan .

518723 3/1940 United Kingdom .

*Primary Examiner*—Gary F. Paumen

*Attorney, Agent, or Firm*—Oblon, Spivak, McClelland, Maier & Neustadt, P.C.

[57] ABSTRACT

A bus bar connector of fewer parts to be easily assembled where plural grooves are formed in the outer periphery of a guide plate so as to position and to prevent plural contact plates from inclining, and a supporting arm is provided at a part of the outer periphery of the guide plate whereby the shield is securely supported by fitting the supporting arm into an annular groove or an engaging hole formed in the inner wall of the shield, also a half of the shield is integrally formed with the guide plate and coupled with the remaining half of the shield whereby the shield is fixedly supported as the guide plate is fixed to the conductive unit.

2 Claims, 22 Drawing Sheets

BUS BAR CONNECTOR

This is a division of application Ser. No. 08/406,041 filed on Mar. 17, 1995, now U.S. Pat. No. 5,482,481, which is a division of application Ser. No. 08/045,814 filed on Apr. 9, 1993, now U.S. Pat. No. 5,423,700.

BACKGROUND OF THE INVENTION

1. Field of the Invention

This invention relates to a bus bar connector for use in a switching device of an electric plant such as a sulfur hexafluoride ($SF_6$) gas insulation switching device, etc.

2. Description of the Related Art

FIG. 1 indicates a longitudinal cross section of a conventional bus bar connector disclosed, for example, in the Japanese Utility Model Application Laid-Open No. 61-82367 (1986). In the drawing, reference numerals 1 and 2 represent first and second conductive units provided opposite to each other in the axial direction of the connector, with small-diameter contact portions 1*a* and 2*a* at the respective ends thereof. A plurality of thin contact plates 3 are arranged radially around the axial center of the connector. Both ends of the inner periphery of the contact plates 3 are pressed to be in touch with the contact portions 1*a*, 2*a* by annular springs 7 fitted around the outer periphery of the contact plates 3.

A circular guide plate 5 is mounted to the end face of the contact portion 1*a* of the first conductive unit 1 by a bolt 6. The peripheral edge of the guide plate 5 is engaged with notches formed in the inner periphery of the contact plates 3 to thereby radially position the contact plates 3. A shield 8 for shielding an electric field by covering the contact parts is provided so as to prevent the partial discharge or short-circuit resulting from the application of a high voltage. A plurality of supporting plates 9 are securely fixed in the inner peripheral wall of the shield 8 in a manner as to be inserted between the contact plates 3, thereby to prevent the contact plates 3 from inclining. The shield 8 is held by a plurality of flat springs 10 in pressed contact with some of the contact plates 3.

The bus bar connector comprised of a plurality of contact plates 3, the shield 8 and the like as depicted above is mounted to the first conductive unit 1. As the contact portion 2*a* of the second conductive unit 2 is inserted into the bus bar connector from the opposite side to the first conductive unit 1 and brought in touch with the inner periphery of the plurality of contact plates 3 whereby the second conductive unit 2 is connected with the first conductive unit 1.

As described above, the conventional bus bar connector needs a plurality of flat springs 10 to hold the shield 8 and also a plurality of supporting plates 9 to position and prevent the contact plates 3 from inclining, and thus disadvantageously increases the number of component parts. Hence, the structure becomes complicated, which makes the assembling work difficult and raise costs.

SUMMARY OF THE INVENTION

This invention has been devised to solve the aforementioned disadvantages and has for its object to provide an inexpensive bus bar connector which is simple in structure with reduced number of parts and easy to assemble.

The above and further objects and features of the invention will more fully be apparent from the following detailed description with accompanying drawings.

DESCRIPTION OF THE PREFERRED EMBODIMENTS

Now, this invention will be discussed in detail taken in conjunction with preferred embodiments thereof with reference to the accompanying drawings.

(Embodiment 1)

Figure 1:
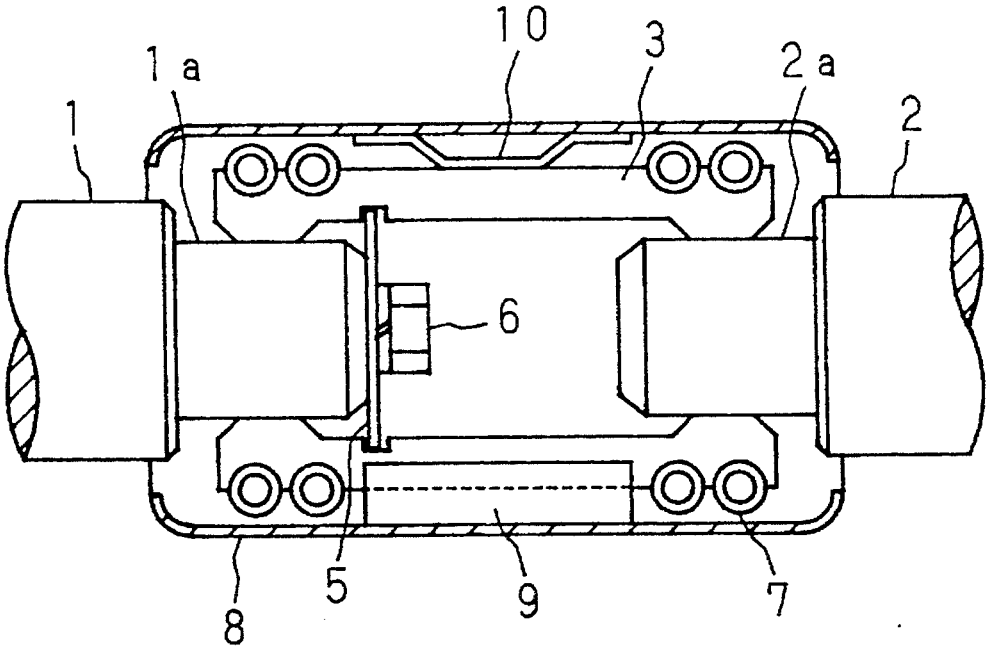
Fig. 1 Prior Art
FIG. 1 is a longitudinal cross sectional view of a conventional bus bar connector.
Figure 2:
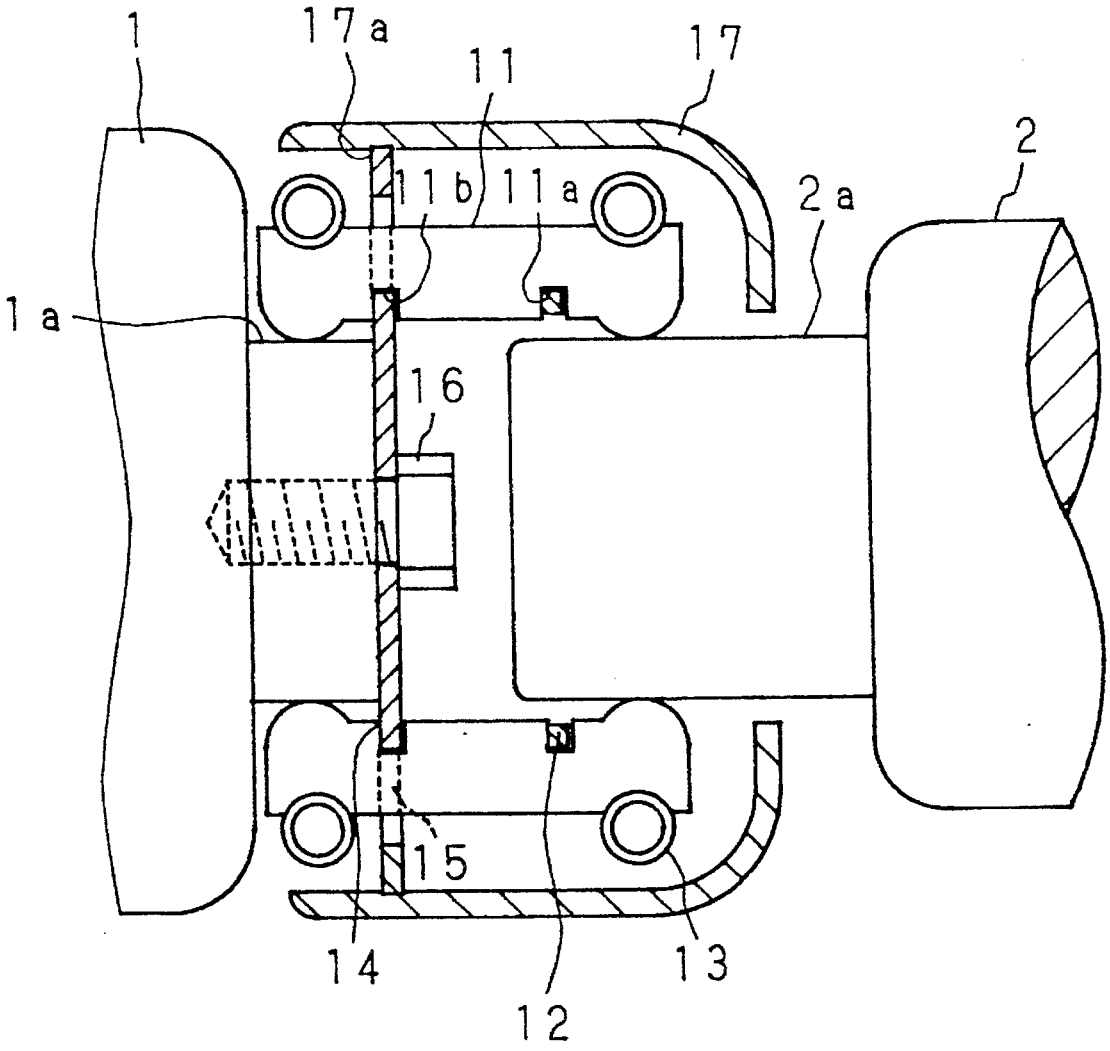
FIG. 2 is a longitudinal cross sectional view of a bus bar connector according to this invention.
Figure 3:
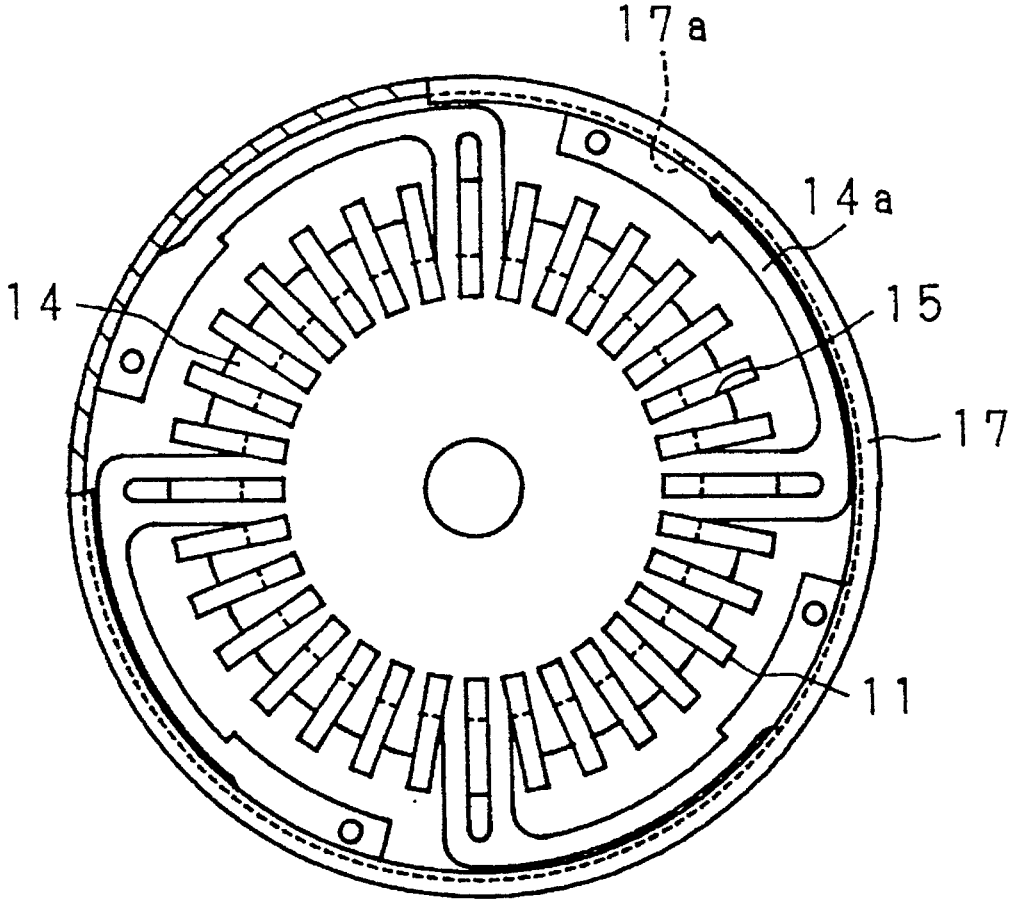
FIG. 3 is a front elevational view of a bus bar connector according to a first embodiment of this invention seen from the side of a second conductive unit.
Figure 4:
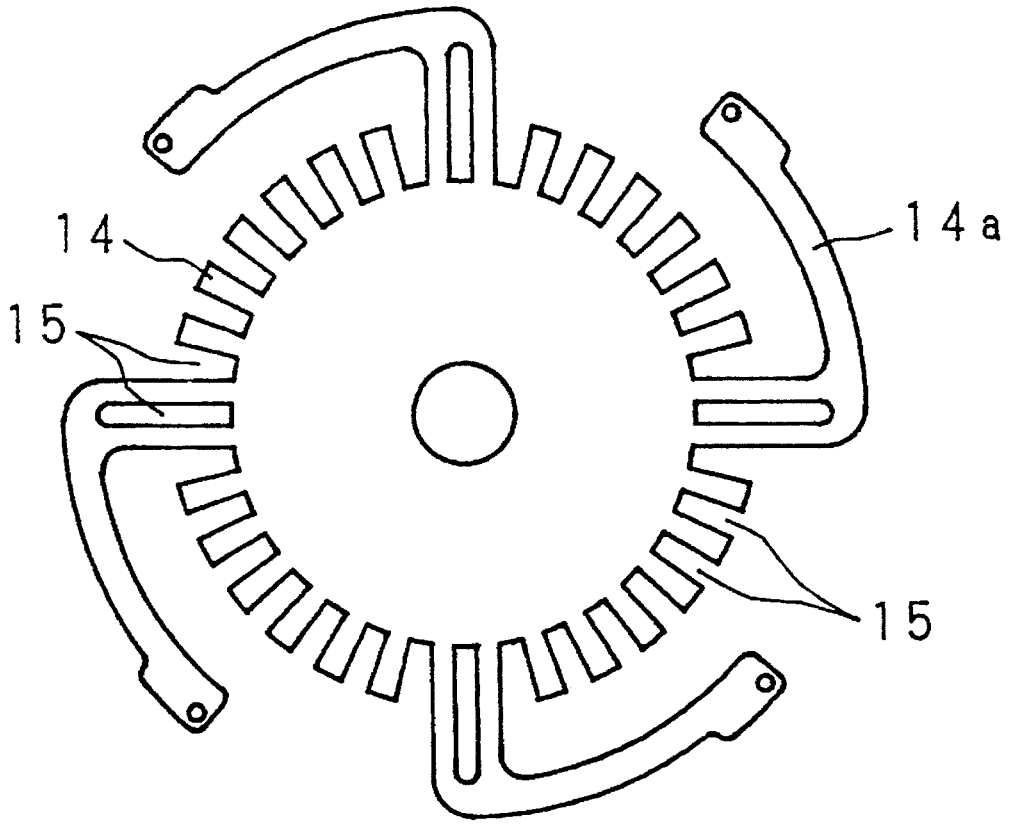
FIG. 4 is a front elevational view of a guide plate of the connector of FIG. 3.

FIG. 2 is a longitudinal cross sectional view of a bus bar connector according to a first embodiment of this invention and FIG. 3 is a front elevational view of the connector of FIG. 2 seen from the side of a second conductive unit. In FIGS. 2 and 3, a plurality of rectangular thin contact plates 11 are radially arranged around the axial center of first and second conductive units 1 and 2. Both inner peripheral ends of each contact plate 11 project in arc and the projecting parts are held in touch with contact portions 1*a* and 2*a* of the first and second conductive units 1 and 2. The contact plate 11 has a notch 11*a* formed closer to the second conductive unit 2 and a notch 11*b* formed closer to the first conductive unit 1 in the inner periphery thereof. A guide ring 12 is fitted in the notch 11*a*. The contact plates 11 are pressed in touch with the contact portions 1*a* and 2*a* at either inner peripheral end thereof by annular springs 13 fitted around the outer periphery thereof.

At the end face of the contact portion 1*a* of the first conductive unit 1 is mounted a substantially circular guide plate 14 by means of a bolt 16. The contact plates 11 are supported by a plurality of corresponding grooves 15 formed in the outer periphery of the guide plate 14. The guide plate 14 engages the bottom of the each groove 15 with the notch 11*b* of the each contact plate 11 to keep the plural contact plates 11 cylindrical and to prevent them from inclining.

There are further provided four supporting arms 14*a* integrally formed with the guide plate 14, extended from four points in the outer periphery of the guide plate 14 at equal pitches. The front end of each supporting arm 14*a*, which is elastic and able to deform inward, curves along the outer periphery of the guide plate 14. A round hole is formed at the front end of the supporting arm 14*a*. The guide plate 14 and the supporting arms 14*a* can be easily manufactured by press working.

A cylindrical shield 17 shields an electric field by covering the contact parts, with an annular groove 17*a* formed in the inner wall. By inserting the supporting arms 14*a* of the guide plate 14 into the annular groove 17*a*, the shield 17 is supported.

In assembling the bus bar connector, while deforming the supporting arms 14*a* inward by inserting closing pins into the round holes of the supporting arms 14*a* of the guide plate 14 which is mounted to the contact portion 1*a* of the conductive unit 1 by the bolt 16, the shield 17 is installed and fixed, and then the supporting arms 14*a* are released from the elastic deformation thereof to be restored into the annular groove 17*a* so that the supporting arms 14*a* are fitted in the annular groove 17*a*. As a result, the shield 17 is securely held by the guide plate 14.

(Embodiment 2)

Figure 5:
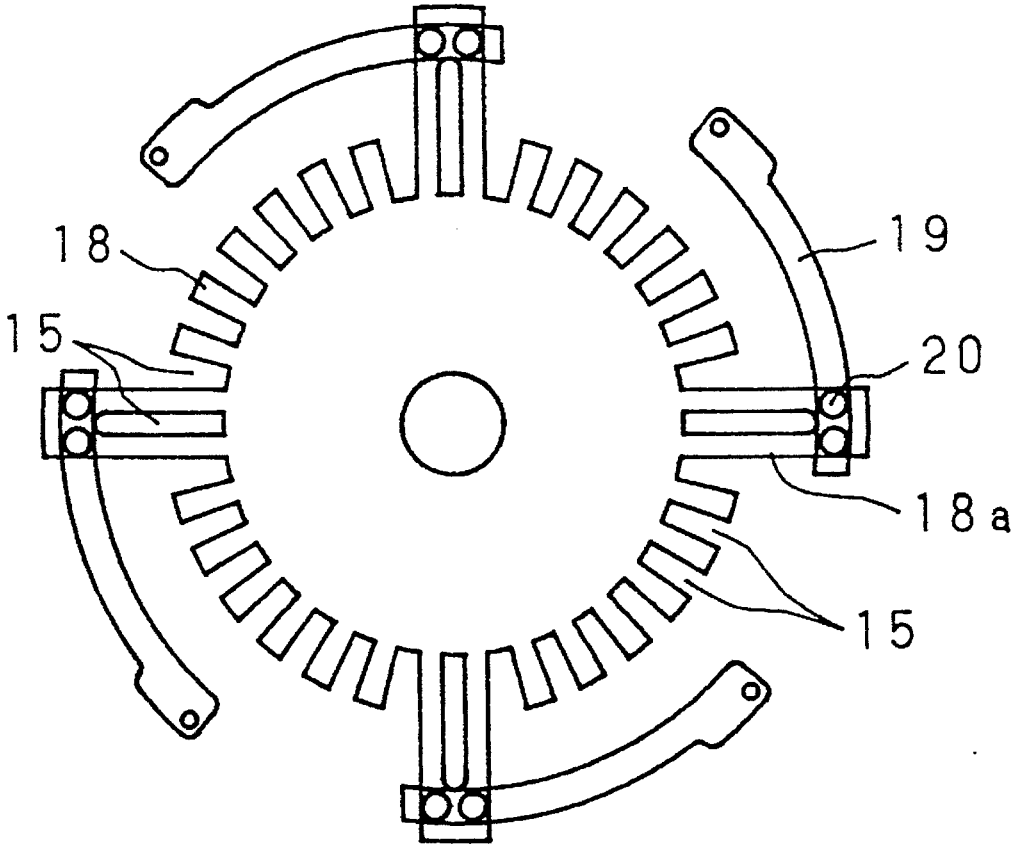
FIG. 5 is a front elevational view of a guide plate of a bus bar connector according to a second embodiment of this invention.

FIG. 5 is a front elevational view of a guide plate of a bus bar connector according to a second embodiment of this invention. The same parts as in the above Embodiment 1 are designated by the same reference numerals and the description will be abbreviated here.

A plurality of grooves 15 are formed in the outer periphery of a guide plate 18 to support a plurality of contact plates 11. By engaging the bottom of each groove 15 with the notch 11*b* of the each contact plate 11, the guide plate 18 positions a plurality of the contact plates 11 radially and prevents them from inclining.

Four projecting parts 18*a* project in the radial direction from four points of the outer periphery of the guide plate 18, which are integrally formed with the guide plate 18. A supporting arm 19 of elastic metal arching along the peripheral curve of the guide plate 18 is fixed to the front end of the projecting parts 18*a* at the rear end thereof by a fastening instrument 20 such as a rivet or the like. A round hole to insert a closing pin is formed at the front end of the supporting arm 19.

In assembling the bus bar connector, while deforming the supporting arms 19 inward by inserting closing pins into the round holes of the supporting arms 19 the shield 17 is installed and fixed, and then the supporting arms 19 are released from the elastic deformation thereof to be restored into the annular groove 17*a* so that the supporting arms 14*a* are fitted in the annular groove 17*a*. As a result, the shield 17 is securely held by the guide plate 18.

(Embodiment 3)

According to the Embodiment 3, the supporting arm 19 of FIG. 5 is made of a shape memory alloy, which has such characteristics as to keep the shape of the supporting arm 19 at front end to engage with the annular groove 17*a* of the shield 17 at the using temperature of the connector. When fixing the shield 17, the supporting arm 19 is first set at low temperatures and deformed more inward than the position where it is engaged with the annular groove 17*a*. When the temperature returns to the using temperature, the supporting arm 19 is inserted into the annular groove 17*a* and the shield 17 is securely supported.

(Embodiment 4)

Figure 6:
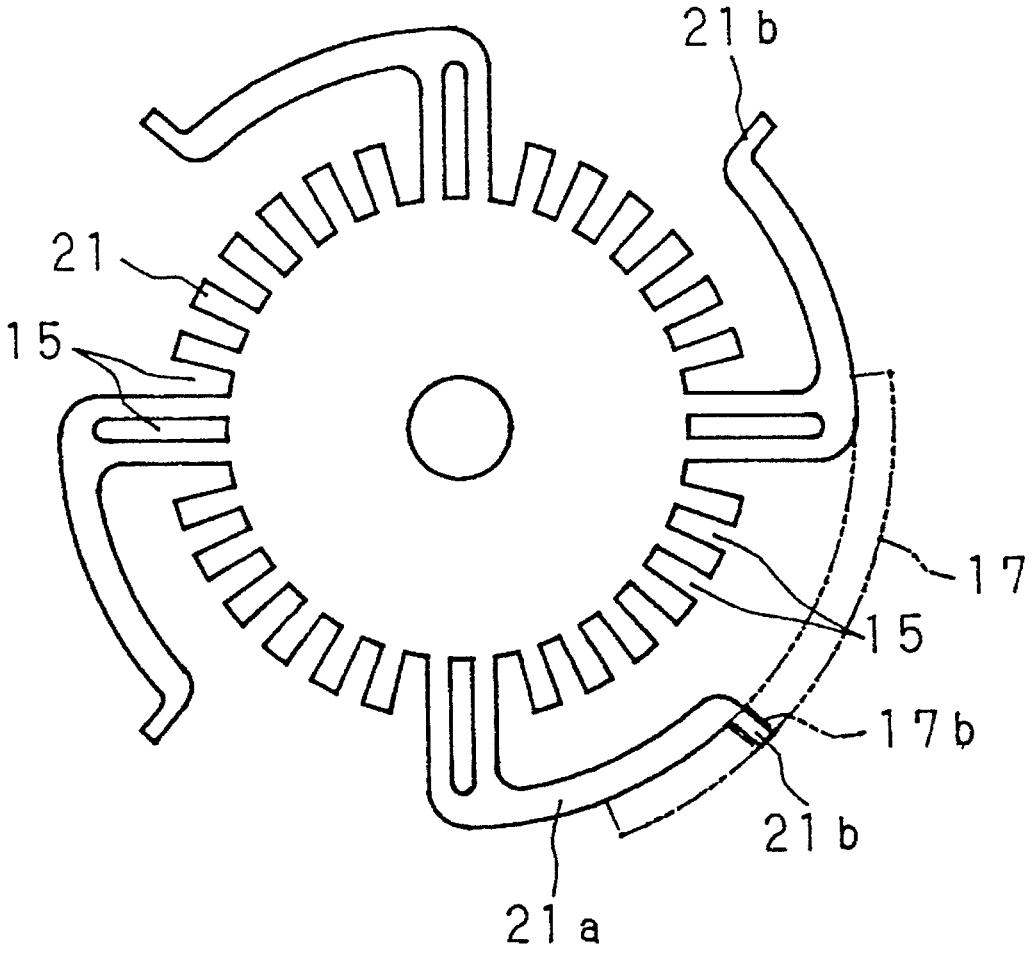
FIG. 6 is a front elevational view of a guide plate of a bus bar connector engaged with a shield according to a fourth embodiment of this invention.

FIG. 6 is a front elevational view of a guide plate of a bus bar connector according to a fourth embodiment of this invention, wherein the guide plate is engaged with the shield. The same parts as in the foregoing embodiments are designated by the same reference numerals, and the description thereof will be abbreviated.

A plurality of grooves 15 are formed in the outer periphery of a guide plate 21 so as to support a plurality of the contact plates 11. The guide plate 21 fits the bottom part of each groove 15 in the notch 11*b* of the each contact plate 11, thereby positioning the contact plates 11 radially and preventing the contact plates 11 from inclining.

Moreover, four supporting arms 21*a* are extended from four points of the outer periphery of the guide plate 21 at equal pitches arching along the curve of the outer periphery of the guide plate 21, and formed integrally with the guide plate 21. The four supporting arms 21*a* are elastic and able to deform inward. The front end of each supporting arm 21*a* is crooked in the radial direction of the guide plate 21, thereby defining an engaging part 21*b*.

A plurality of engaging holes 17*b* are formed in the inner wall of the shield 17. When the engaging part 21*b* at the front end of each supporting arm 21*a* is fitted in the engaging hole 17*b* after being once deformed inward, the shield 17 is fixed and supported.

(Embodiment 5)

Figure 7:
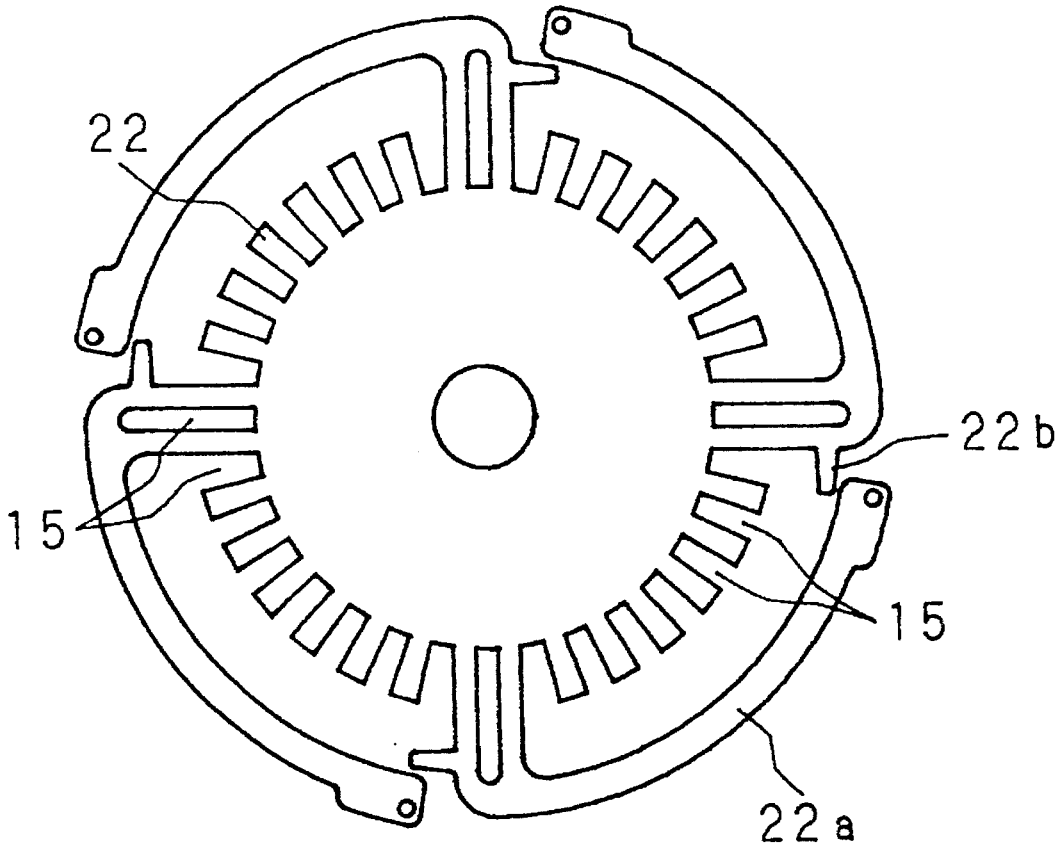
FIG. 7 is a front elevational view of a guide plate of a bus bar connector according to a fifth embodiment of this invention.

FIG. 7 shows a front elevational view of a guide plate of a bus bar connector according to a fifth embodiment of this invention. Similar to the Embodiment 1, arching supporting arms 22*a* which can be deformed inward are formed in the outer periphery of the guide plate 22. Moreover, a protrusion 22*b* is formed at the base end of the supporting arm 22*a* to restrict the inward elastic deformation of the neighboring supporting arm 22*a*.

Therefore, when deforming the supporting arms 22*a* inward to fix the shield 17, since the elastic deformation of the supporting arm 22*a* is restricted by the protrusion 22*b* of the adjacent supporting arm 22*a*, each supporting arm 22*a* is prevented from being permanently deformed in consequence of the excessive deformation.

(Embodiment 6)

Figure 8:
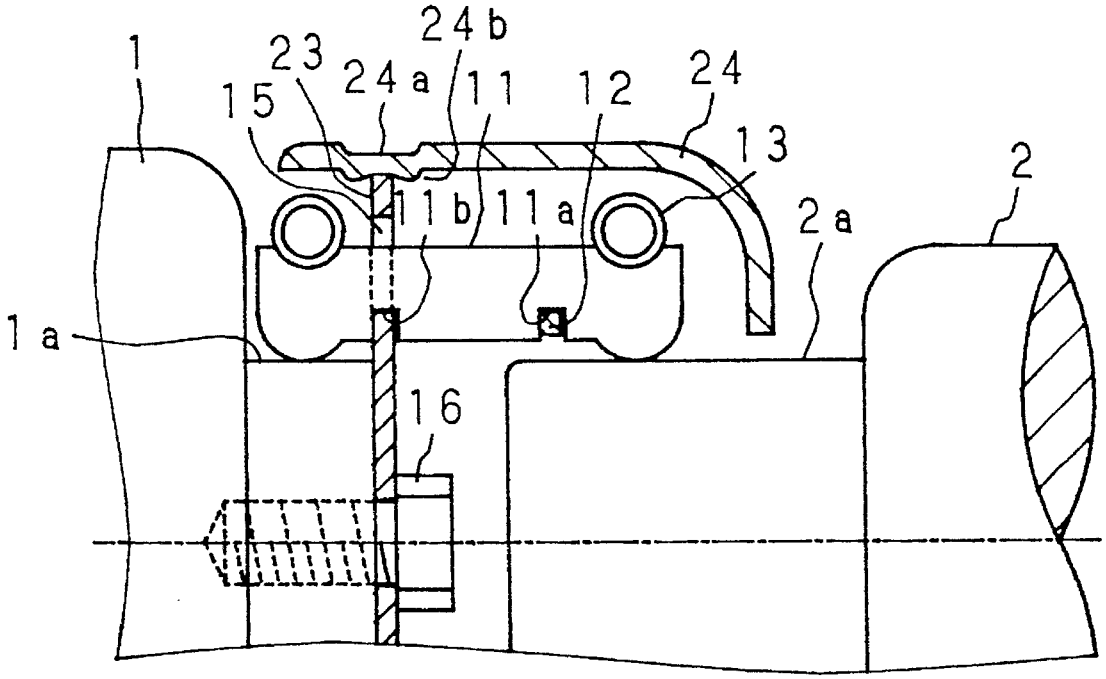
FIG. 8 is a longitudinal cross sectional view of the upper half of a bus bar connector according to a sixth embodiment of this invention.
Figure 9:
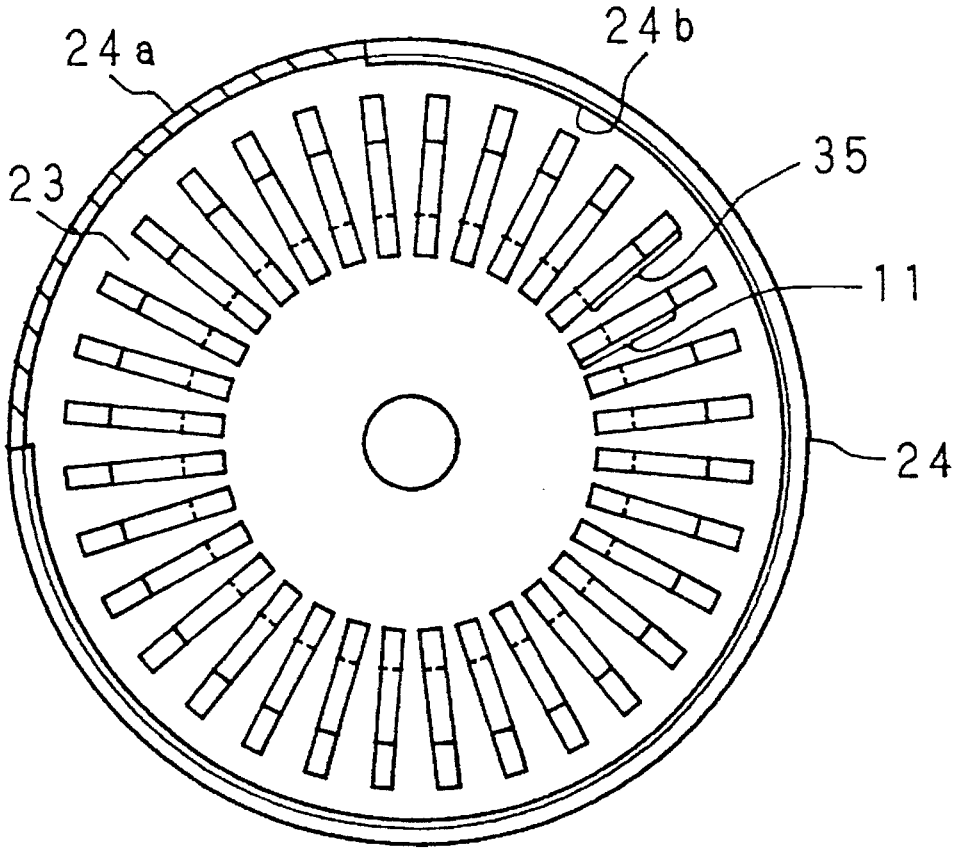
FIG. 9 is a front elevational view of the bus bar connector of FIG. 8 seen from the side of a second conductive unit.

FIG. 8 is a longitudinal cross sectional view of the upper half of a bus bar connector according to a sixth embodiment of this invention, and FIG. 9 is a front elevational view of the bus bar connector of FIG. 8 seen from the side of a second conductive unit 2. The same parts as in the foregoing embodiments are denoted by the same reference numerals, the description of which will be abbreviated for brevity.

A plurality of slits 35 are radially formed closer to the outer periphery of a circular guide plate 23 so as to support a plurality of contact plates 11. The guide plate 23 fits a bottom edge of each slit 35 with the notch 11*b* of each contact plate 11 to position the contact plates 11 radially. At the same time, the contact plates 11 are prevented by the guide plate 23 from inclining.

A shield 24 is fitted in the outer periphery of the guide plate 23. When the pressure is added to a point 24*a* of the shield 24 corresponding to the guide plate 23 from the outer periphery of the shield 24 through roll processing using a pressure roller for drawing, protrusions 24*b* are obtained to hold the outer periphery of the guide plate 23 from both sides. The shield 24 is fixedly supported owing to the guide plate 23 held by the protrusions 24*b*.

(Embodiment 7)

Figure 10:
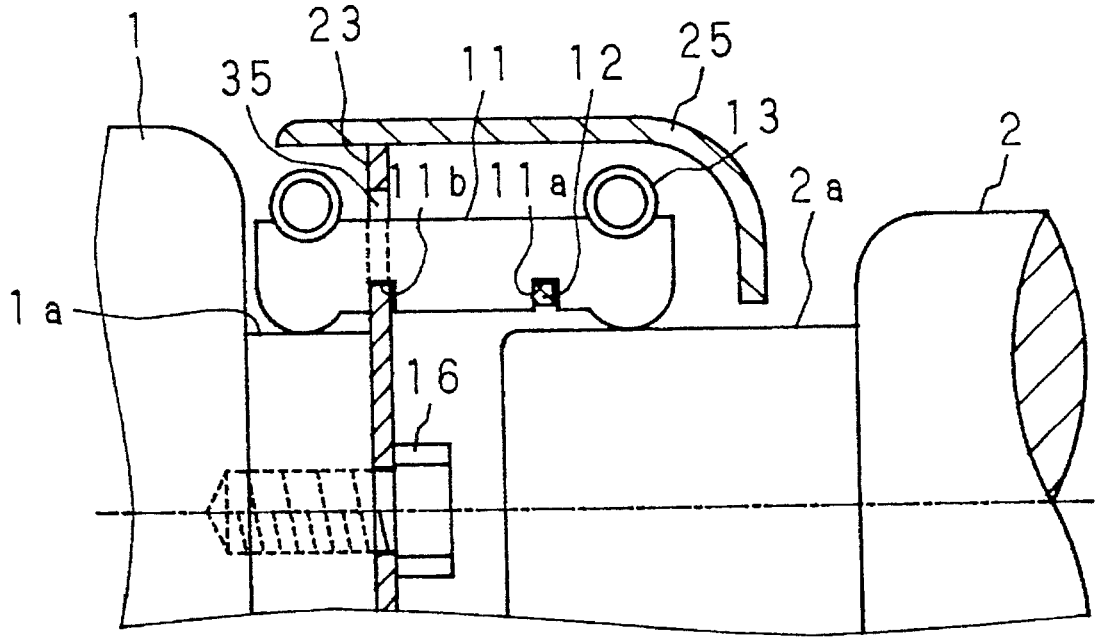
FIG. 10 is a longitudinal cross sectional view of the upper half of a bus bar connector according to a seventh embodiment of this invention.

FIG. 10 is a longitudinal cross sectional view of the upper half of a bus bar connector according to a seventh embodiment of this invention. A guide plate 23 is similar to that shown in FIG. 9. It is to be noted here that the same parts are designated by the same reference numerals and the description will be abbreviated.

A shield 25 is fixedly fitted in the outer periphery of the circular guide plate 23 by spot welding or friction welding or by using an adhesive.

(Embodiment 8)

Figure 11:
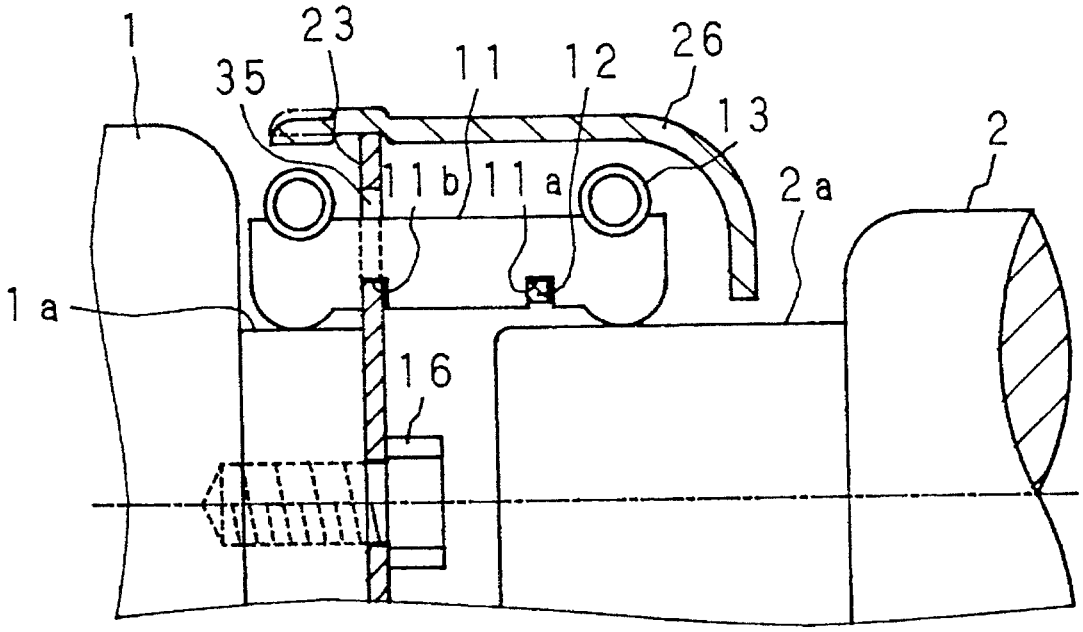
FIG. 11 is a longitudinal cross sectional view of the upper half of a bus bar connector according to an eighth embodiment of this invention.

FIG. 11 is a longitudinal cross sectional view of the upper half of a bus bar connector according to an eighth embodiment of this invention. A guide plate 23 in FIG. 11 is the same as indicated in FIG. 9. The same parts as in the above embodiments are denoted by the same reference numerals, and the description thereof will be omitted here.

In the first place, a shield 26 is formed to be stepped to make a diameter on one side larger than another side as shown by a chain line which agrees with the diameter of the guide plate 23. Then, the larger-diameter part of the shield 26 is fitted with the guide plate 23. The shield 26 is positioned where the stepped part butts against the guide plate 23. Thereafter, the pressure is added to the one end of the shield 26 with the expanded diameter through rolling or the like, and the shield 26 is drawn to the inner peripheral until it has the diameter indicated by a solid line. As described above, the shield 26 is easily and correctly positioned by the guide plate 23, and moreover, the shield 26 is fixedly supported by the guide plate 23.

(Embodiment 9)

Figure 12:
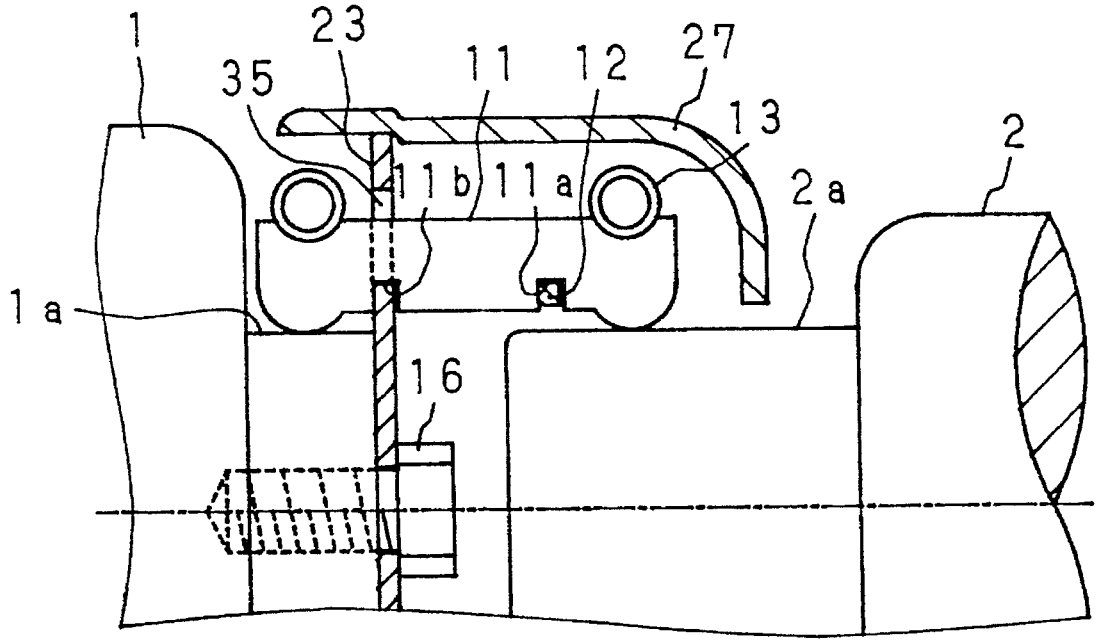
FIG. 12 is a longitudinal cross sectional view of the upper half of a bus connector according to a ninth embodiment of this invention.

FIG. 12 is a longitudinal cross sectional view of the upper half of a bus bar connector according to a ninth embodiment of this invention, in which a guide plate 23 is the same as shown in FIG. 9. The same parts are represented by the same reference numerals, and the description thereof will be abbreviated.

A shield 27 is formed to be stepped to make a diameter on one side larger than another side as shown by a chain line which agrees with the diameter of the guide plate 23. Then, the larger-diameter part of the shield 27 is fitted with the guide plate 23. The shield 27 is positioned where the guide plate 23 butts against the stepped part of the shield 27. Subsequently, the shield 27 is secured by spot welding or friction welding, or using an adhesive or the like, to the guide plate 23.

(Embodiment 10)

Figure 13:
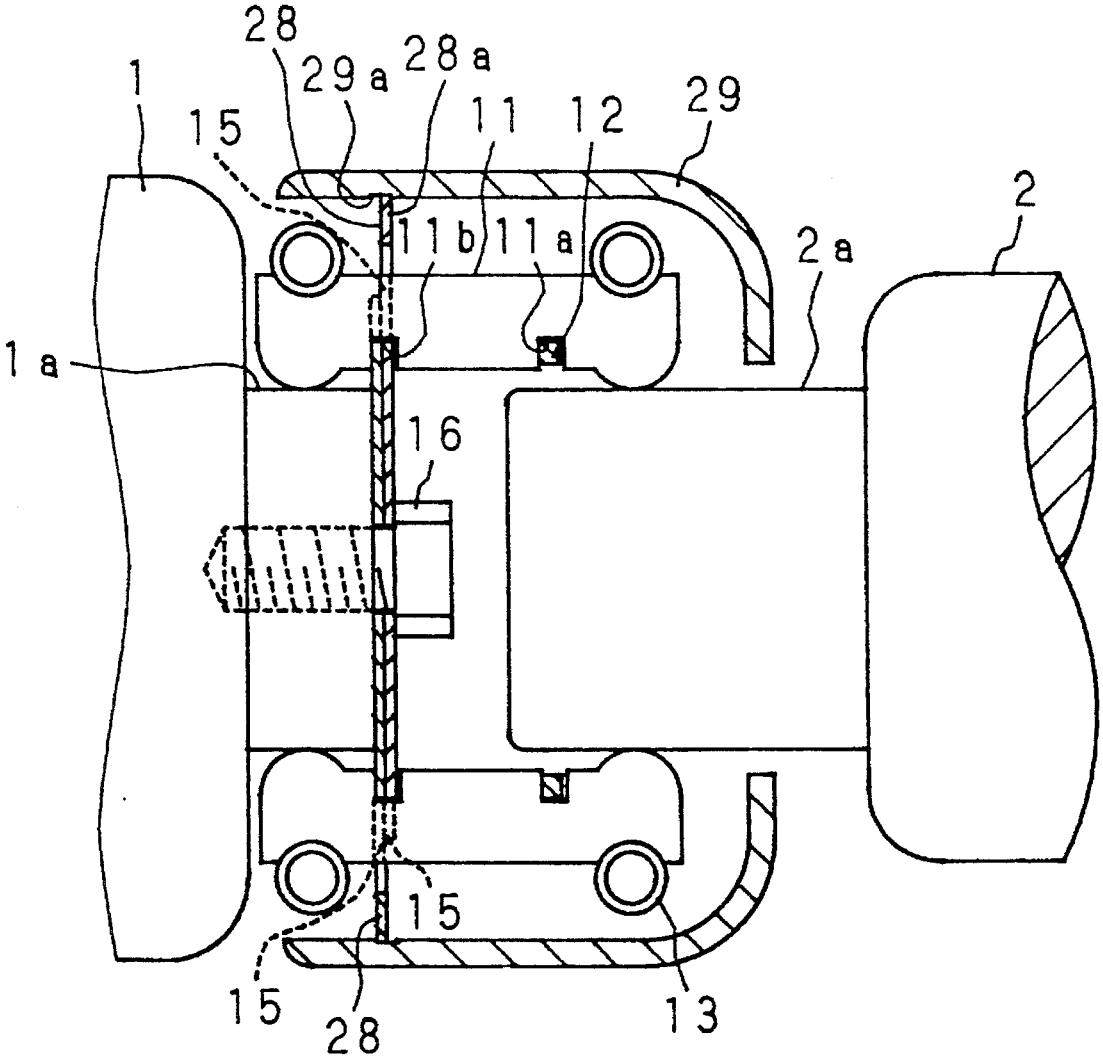
FIG. 13 is a longitudinal cross sectional view of the upper half of a bus bar connector according to a tenth embodiment of this invention.
Figure 14:
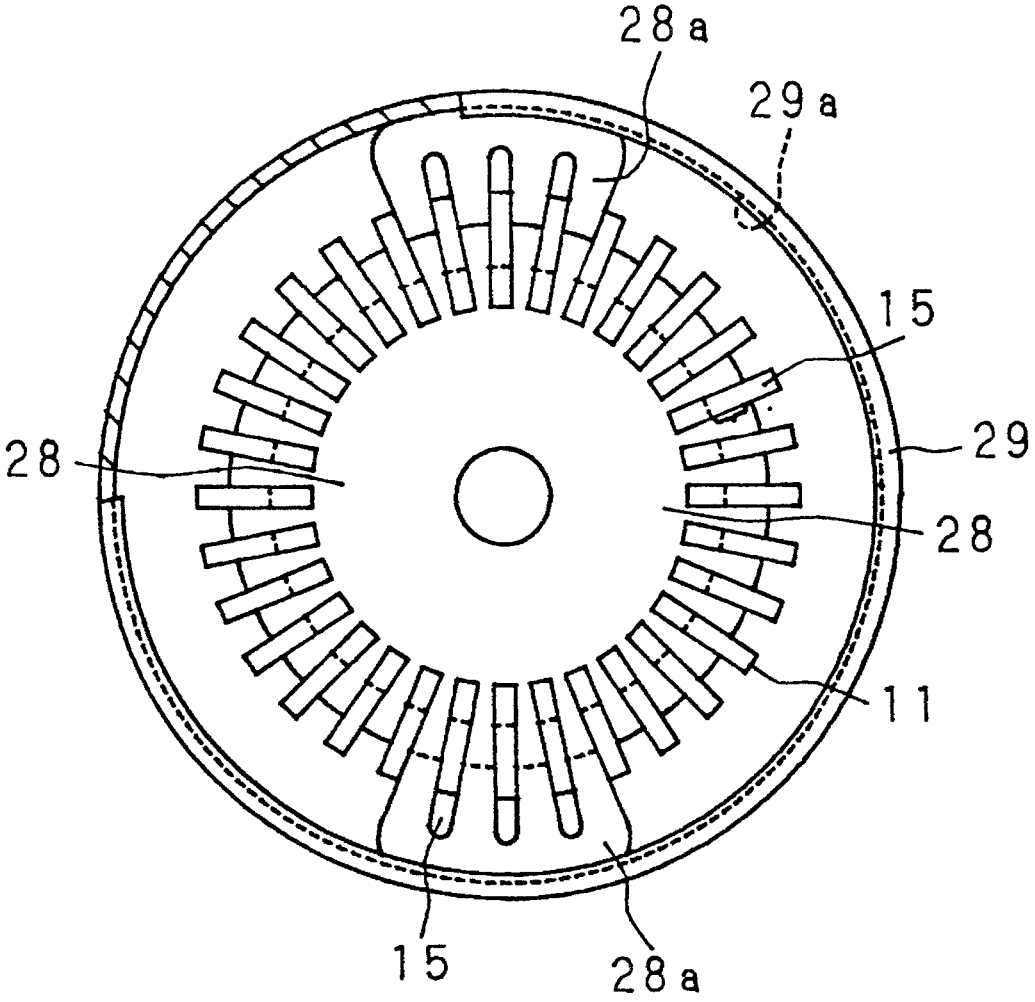
FIG. 14 is a front elevational view of the bus bar connector of FIG. 13 seen from the side of second conductive unit.
Figure 15:
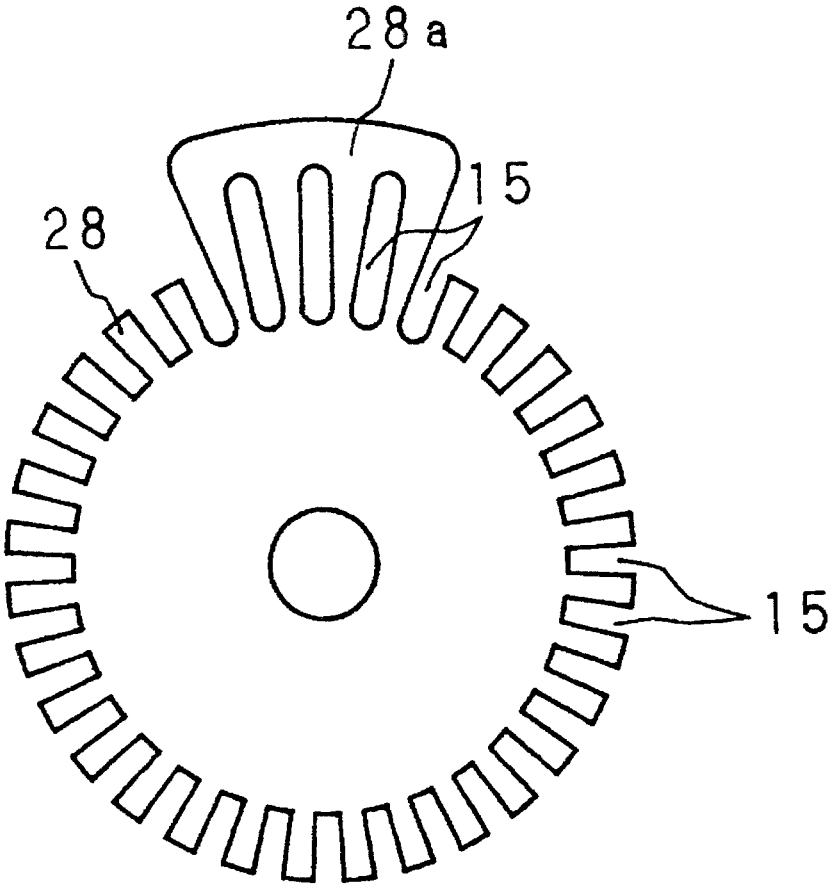
FIG. 15 is a front elevational view of a guide plate of the connector of FIG. 14.
Figure 16:
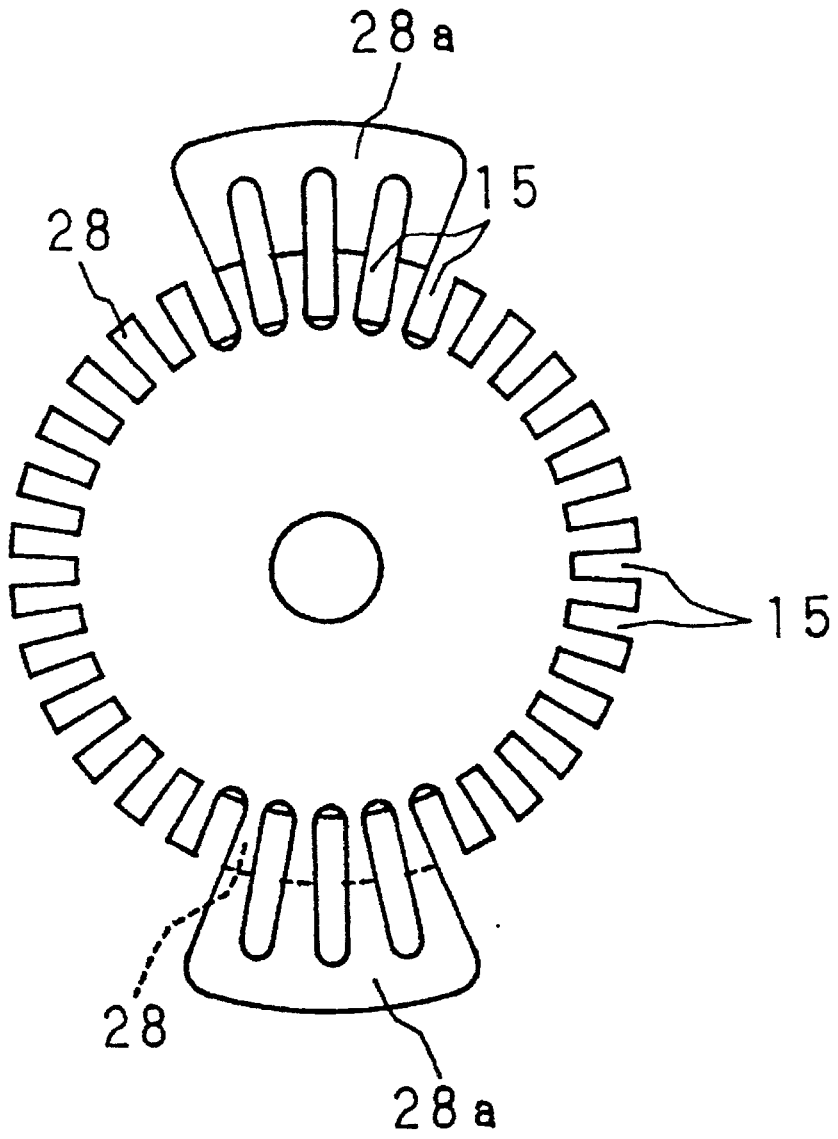
FIG. 16 is a front elevational view showing the state when two guide plates of FIG. 15 are overlapped.

FIG. 13 is a longitudinal cross sectional view of a bus bar connector according to a 10th embodiment of this invention. FIG. 14 is a front elevational view of the bus bar connector of FIG. 13 seen from the side of a second conductive unit. FIG. 15 is a front elevational view of a guide plate, and FIG. 16 indicates a front elevational view of two guide plates of FIG. 15 in the overlapped state. The same parts as in the foregoing embodiments are designated by the same reference numerals throughout FIGS. 13–16 and the description will be omitted here.

According to Embodiment 10, two guide plates 28 are overlapped in use. As shown in FIG. 15, a plurality of grooves 15 are formed in the outer periphery of the guide plate 28 to support the contact plates 11. A fan shape projecting part 28*a* projects in the radial direction from one point of the outer periphery of the guide plate 28. The grooves 15 in the projecting part 28*a* are formed in the shape of slits. Two guide plates 28 each obtained in the above manner are overlapped so that the projecting parts 28*a* are opposed to each other while the grooves 15 of the guide plates 28 agree with each other in position. The thus-overlapped guide plates are mounted to the end face of the contact portion 1*a* of the first conductive unit 1 by a bolt 16.

The projecting parts 28*a* of a pair of the guide plates 28 are inserted into an annular groove 29*a* formed in the inner wall of a shield 29, thereby to support the shield 29. The guide plates 28 fit the bottom part of the each pair of the grooves 15 in the notch 11*b* of the each contact plate 11 thereby to position the contact plates 11 radially and prevent the contact plates 11 from inclining.

(Embodiment 11)

Figure 17:
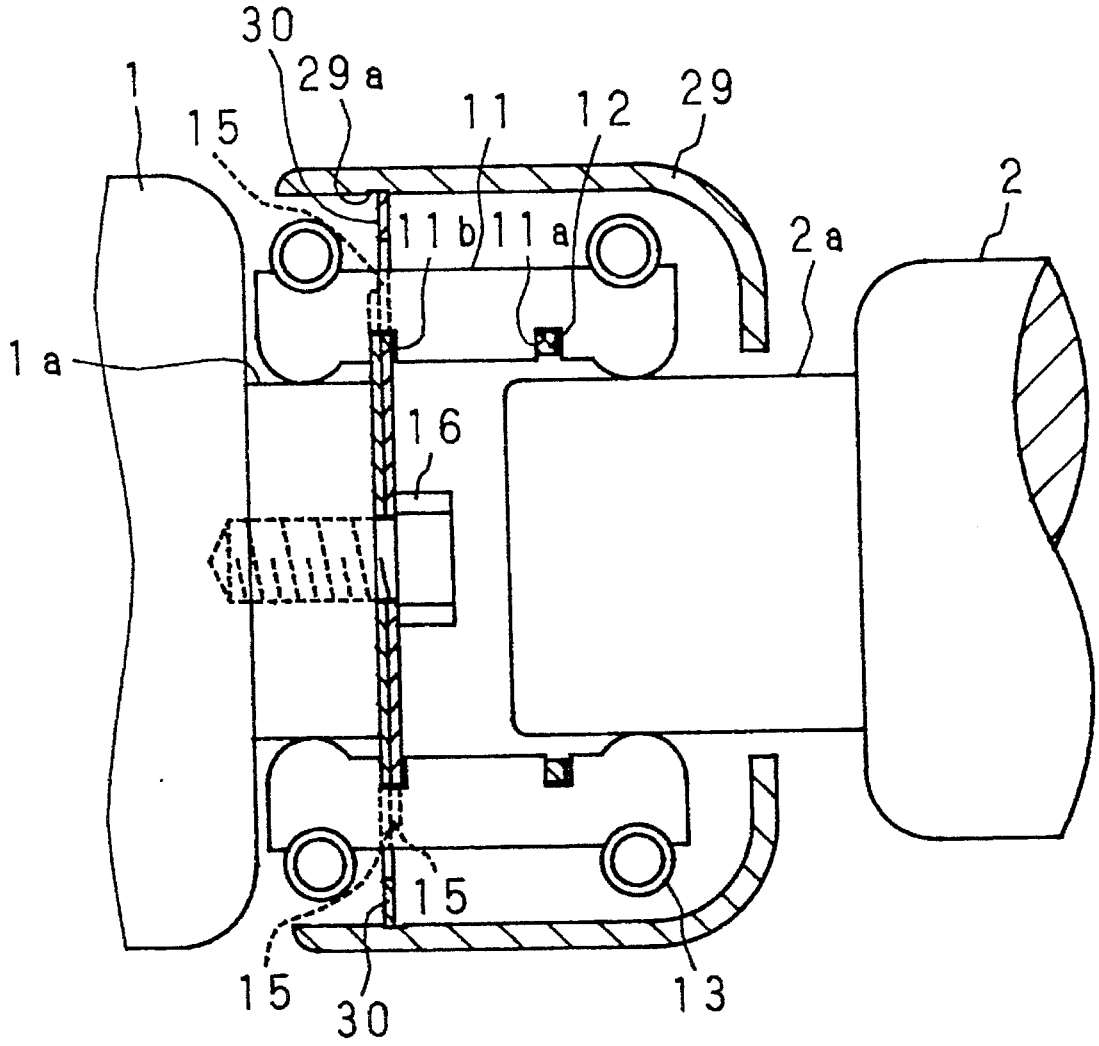
FIG. 17 is a longitudinal cross sectional view of a bus bar connector according to an eleventh embodiment of this invention.
Figure 18:
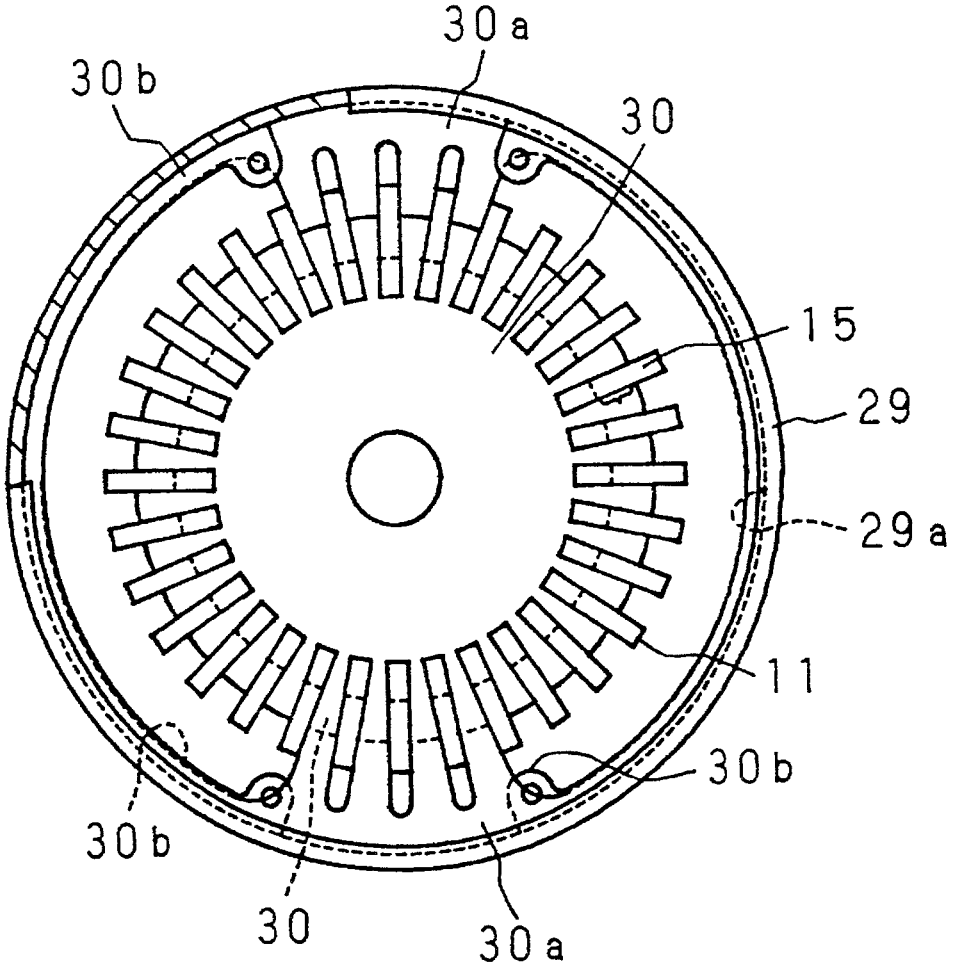
FIG. 18 is a front elevational view of the bus bar connector of FIG. 17 seen from the side of a second conductive unit.
Figure 19:
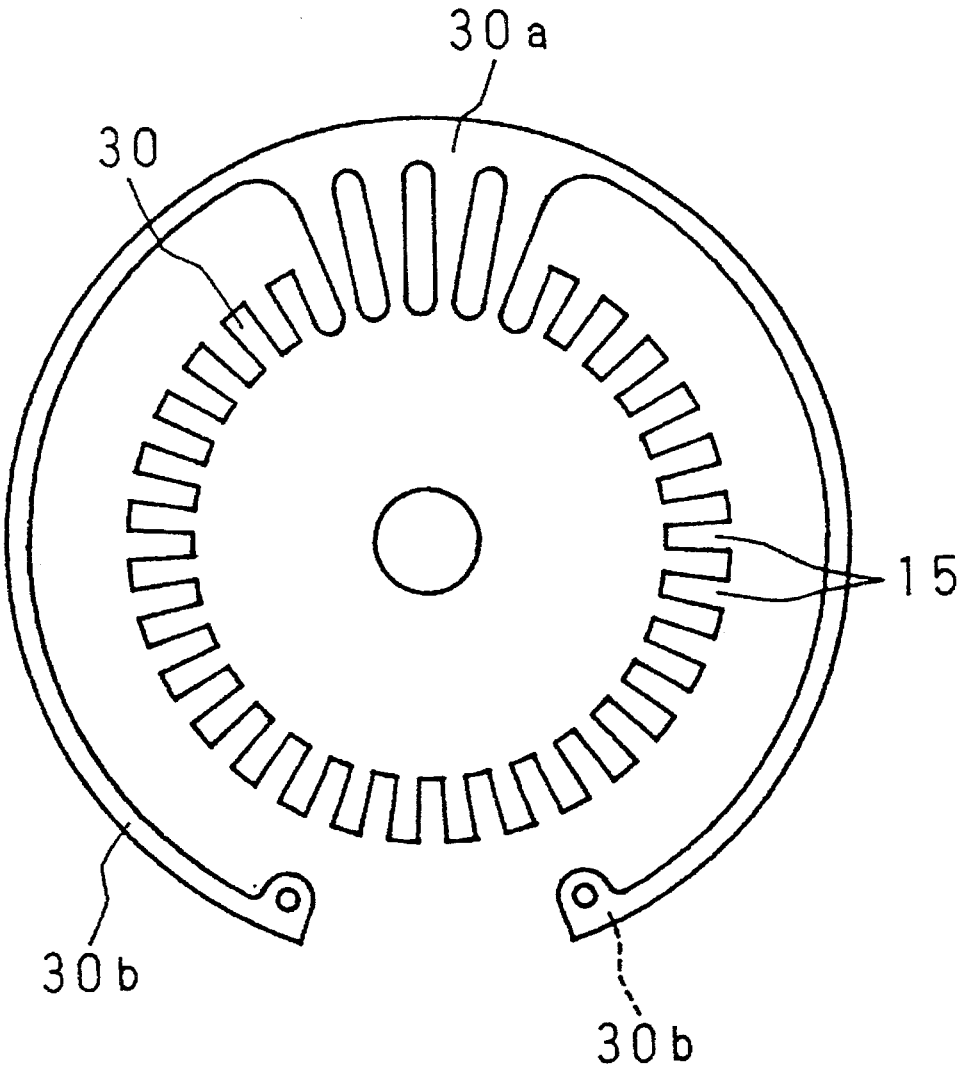
FIG. 19 is a front elevational view of a guide plate of the connector of FIG. 18.
Figure 20:
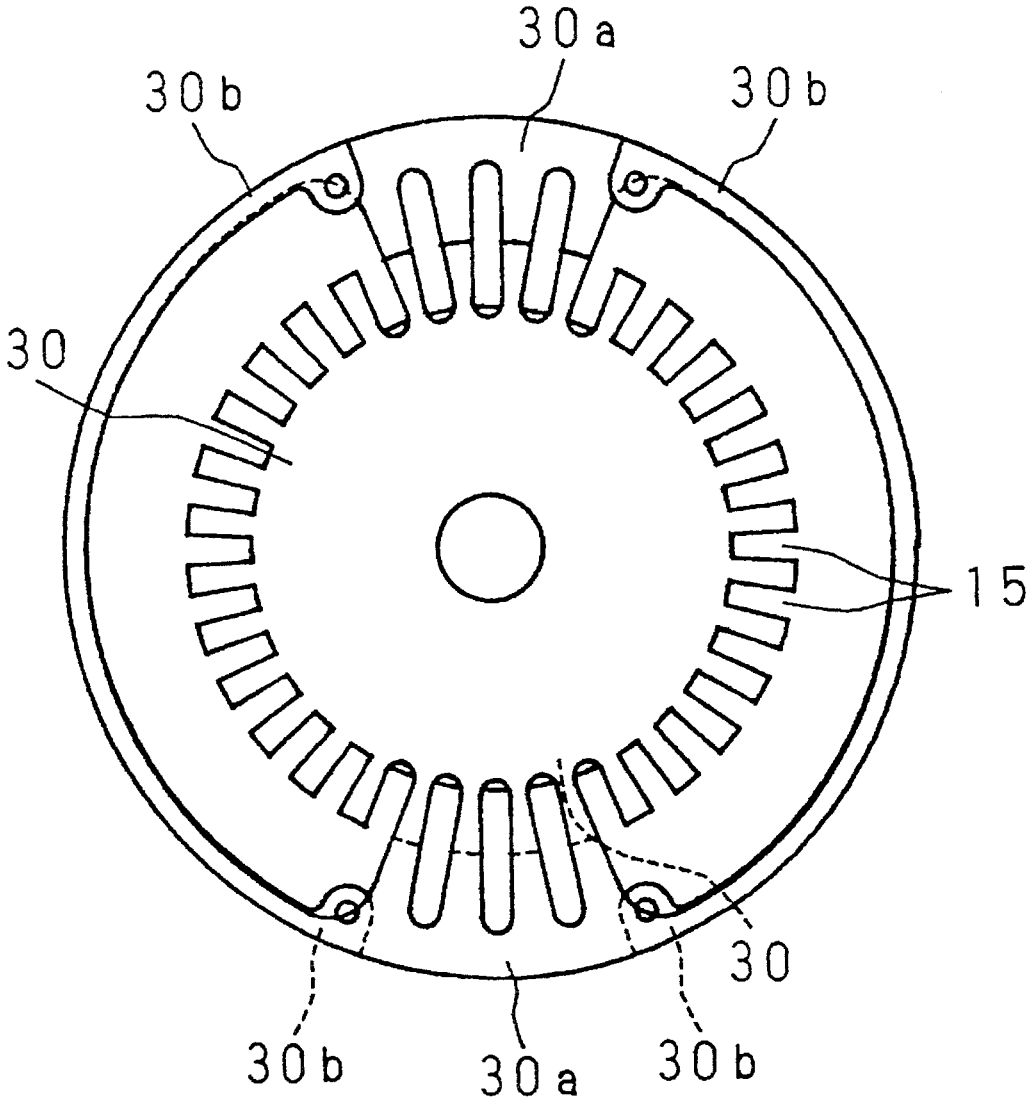
FIG. 20 is a front elevational view showing the state when two guide plates of FIG. 19 are overlapped.

FIG. 17 is a longitudinal cross sectional view of a bus bar connector according to an 11th embodiment of this invention. The front view of the bus bar connector of FIG. 17 seen from the side of a second conductive unit is shown in FIG. 18. FIG. 19 is a front elevational view of one guide plate and FIG. 20 is a front elevational view of two overlapped guide plates of FIG. 19. A shield 29 is the same as shown in FIGS. 13 and 14. The same parts are designated by the same reference numerals and the description thereof will be abbreviated.

Two guide plates 30 are overlapped in use in the Embodiment 11. As is made clear from FIG. 19, a plurality of grooves 15 are notched in the outer periphery of the guide plate 30 so as to support the corresponding contact plates 11. The guide plate 30 has a fan-shaped projecting part 30*a* projecting in the radial direction from one point in the outer periphery thereof. The grooves 15 at the projecting part 30*a* are formed in slits. Moreover, the projecting part 30*a* has arc-shaped supporting arms 30*b* extending along the curve of the outer periphery of the guide plate 30 from either front end thereof. A round hole for inserting a closing instrument is formed at each front end of the supporting arms 30*b*.

As shown in FIG. 20, two guide plates 30 as described above are overlapped in a manner that the projecting parts 30*a* confront each other and the grooves 15 agree with each other in position, which are in turn mounted to the end face of a contact portion 1*a* of a first conductive unit 1 by a bolt 16.

An annular groove 29*a* is formed in the inner peripheral wall of the shield 29. The projecting parts 30*a* and the supporting arms 30*b* of the guide plates 30 are inserted into the annular groove 29*a*, whereby the shield 29 is supported. The guide plates 30 fit the bottom of the each pair of the groove 15 to the notch 11*b* of the each contact plate 11. Accordingly, the contact plates 11 are positioned radially and prevented from inclining.

In assembling the connector, closing pins are respectively inserted into the round holes of the supporting arms 30*b* of the guide plates 30. As the supporting arms 30*b* are elastically deformed inward, the shield 29 is fitted and fixed, and thereafter, the elastic deformation of the front ends of the supporting arms 30*b* is released to return the arms 30*b* into the annular groove 29*a*. Accordingly, the supporting arms 30*b* are fitted in the annular groove 29*a*. In this manner, the shield 29 is securely supported by the guide plates 30.

Since the guide plates 30 are fitted in the annular groove 29*a* of the shield 29 owing to the outward impact resilience of the supporting arms 30*b*, the shield 29 is kept fixed to the guide plates 30 even when the guide plates are not mounted to the first conductive unit 1 by the bolt 16. Therefore, it is convenient that the shield 29 is never detached from the guide plates 30 during the assembly or transfer, etc.

(Embodiment 12)

Figure 21:
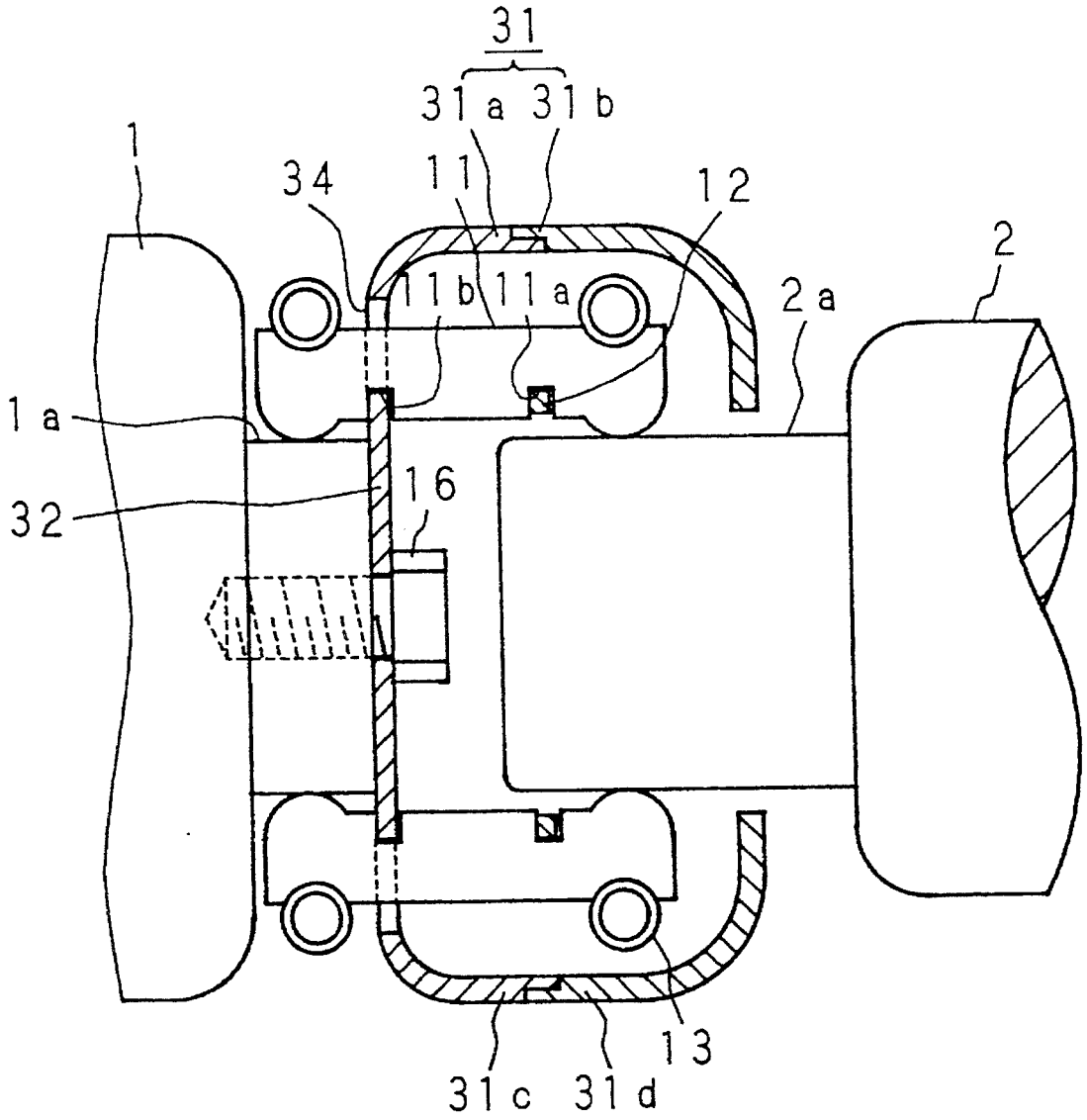
FIG. 21 is a longitudinal cross sectional view of a bus bar connector according to a twelfth embodiment of this invention.
Figure 22:
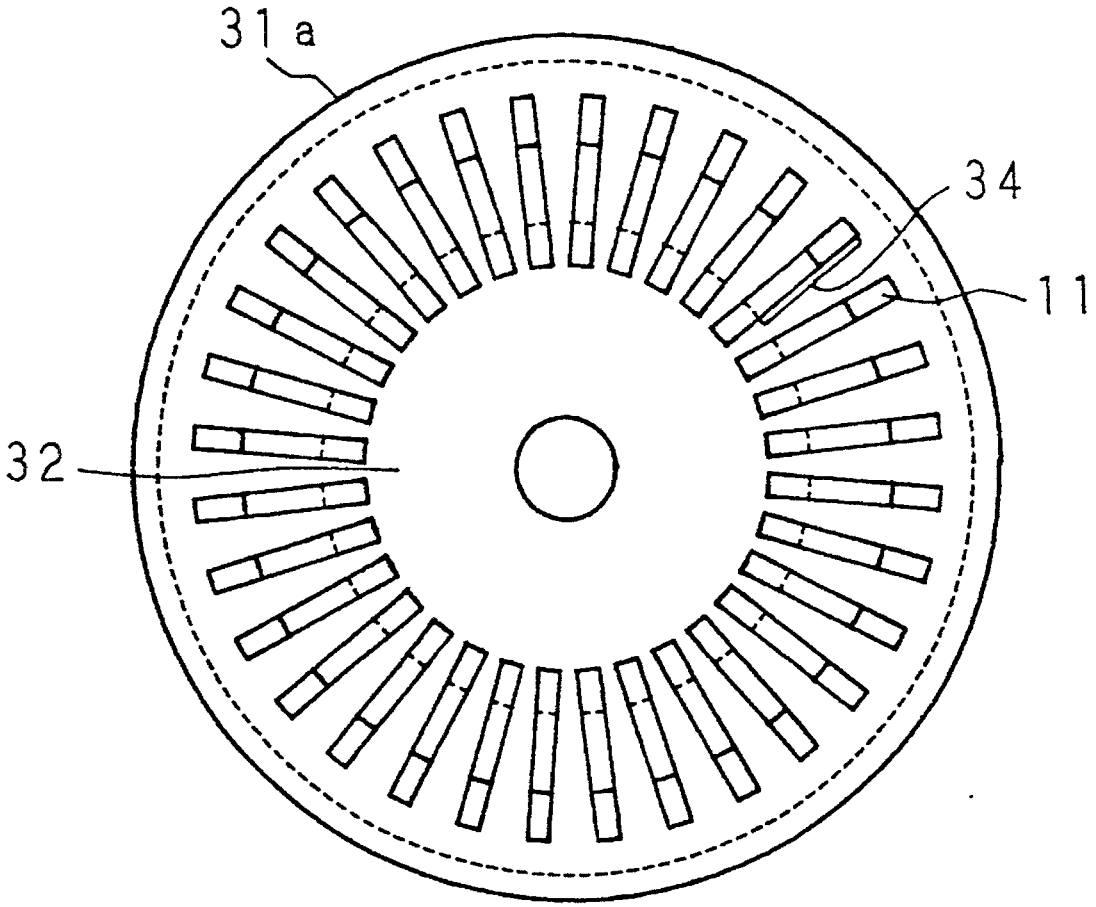
FIG. 22 is a front elevational view of the bus bar connector of FIG. 21 seen from the side of a second conductive unit.

FIG. 21 shows a longitudinal cross sectional view of a bus bar connector according to a 12th embodiment of this invention. FIG. 22 is a front elevational view of the bus bar connector of FIG. 21 seen from the side of a second conductive unit. It is to be noted that the same parts as in the preceding embodiments are denoted by the same reference numerals and the description will be omitted for brevity.

In the drawings, a shield 31 is composed of a front shield 31*a* and a rear shield 31*b* coupled with each other. The front shield 31*a* is cylindrically formed in the continued part from the periphery of a guide plate 32. The cylindrical front shield 31*a* is obtained by drawing the outer periphery of a disc plate larger than the guide plate 32 into the shape of a saucer. A stepped coupling end 31*c* is formed at the end of the front shield 31*a*, while a stepped coupling 31*d* is formed at the end of the rear shield 31*b* to be engaged with the coupling end 31*c* of the front shield 31*a*.

A plurality of slits 34 are radially formed closer to the front shield 31*a* of the guide plate 32 so as to support the contact plates 11. The bottom edge of the each slit 34 is fitted in the notch 11*b* of the each contact plate 11, thereby to position the plurality of contact plates 11 radially and to prevent the contact plates 11 from inclining.

The front and rear shields 31*a*, 31*b* are fitted and coupled with each other at the respective coupling ends 31*c*, 31*d* by spot welding, friction welding, shrinkage fitting, or by use of an adhesive. The front and rear shields may otherwise be screwed by forming a male and a female screws at the respective ends. The front shield 31*a* is fixedly positioned as the guide plate 32 is mounted to the first conductive unit 1 by the bolt 16, and therefore it becomes easy to mount the shield 31, eventually simplifying the assembling work of the bus bar connector.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A bus bar connector comprising:

a contact member including a plurality of contact plates which contact first and second conductive units to thereby electrically connect the first and second conductive units;

a shield for covering the contact member, said shield having an annular groove formed in an inner wall of the shield; and a circular guide plate having projecting parts which project in a radial direction thereof to be fitted in the annular groove of the shield, said circular guide plate being fixed to one of the conductive units and having a plurality of grooves into which the plurality of contact plates of the contact member are fitted, so as to radially support the plurality of contact plates.

2. A bus bar connector according to claim 1, wherein the guide plate comprises two sheets which are overlapped in a manner such that the respective projecting parts are not overlapped while the respective grooves are overlapped, said two sheets of the guide plate being fixed to one conductive unit of said conductive units.

* * * * *